US011214933B2

(12) United States Patent
Lee

(10) Patent No.: US 11,214,933 B2
(45) Date of Patent: Jan. 4, 2022

(54) SYSTEMS AND METHODS FOR MONITORING ACCESS TO A SECURED AREA

(71) Applicant: TOTAL AUTOMATION GROUP, INC., Trafford, AL (US)

(72) Inventor: Stephen Michael Lee, Pinson, AL (US)

( * ) Notice: Subject to any disclaimer, the term of this patent is extended or adjusted under 35 U.S.C. 154(b) by 145 days.

(21) Appl. No.: 16/372,035

(22) Filed: Apr. 1, 2019

(65) Prior Publication Data

US 2019/0301116 A1 Oct. 3, 2019

Related U.S. Application Data

(60) Provisional application No. 62/650,867, filed on Mar. 30, 2018.

(51) Int. Cl.
*E01F 13/08* (2006.01)
*G08G 1/017* (2006.01)

(52) U.S. Cl.
CPC ..... *E01F 13/08* (2013.01); *G08G 1/017* (2013.01)

(58) Field of Classification Search
CPC . E01F 13/08; E01F 9/615; E01F 9/617; E01F 9/669; G01G 1/017; G01G 1/042; G01G 1/052; G01G 1/065; G08G 1/017; G08G 1/042; G08G 1/052; G08G 1/065
USPC ..... 49/49
See application file for complete search history.

(56) References Cited

U.S. PATENT DOCUMENTS 3,205,352 A 9/1965 Prucha
4,576,274 A 3/1986 Thorsen
5,868,360 A 2/1999 Bader et al.
6,195,020 B1 2/2001 Brodeur, Sr. et al.
6,972,693 B2 12/2005 Brown et al.
7,146,345 B2 * 12/2006 Weik, III ..... E05F 1/006 705/418
9,317,724 B2 * 4/2016 Matsur ..... G06K 7/10267
9,666,002 B2 * 5/2017 Haruckstein ..... E01F 13/06
9,710,712 B2 7/2017 Madden et al.
9,732,483 B2 * 8/2017 Marabyan ..... G08B 25/08
10,024,007 B2 * 7/2018 Marabyan ..... G07C 9/00896
10,145,071 B2 * 12/2018 Marabyan ..... G08B 5/36
10,210,397 B2 * 2/2019 Madden ..... G06K 9/00771
2002/0185571 A1 12/2002 Bryant et al.
2010/0259361 A1 * 10/2010 Al Shahrani ..... E01F 13/126 340/5.71
2012/0086558 A1 4/2012 Teske
2012/0146763 A1 6/2012 Teti et al.
(Continued)

FOREIGN PATENT DOCUMENTS

DE 102007061941 A1 6/2009
FR 2913518 B1 10/2010

*Primary Examiner* — Gary S Hartmann

(74) *Attorney, Agent, or Firm* — Shackelford, Bowen, McKinley & Norton, LLP

(57) ABSTRACT

A moveable barrier proximate to an entry point to the secured area may obstruct entry to the secured area or permit access thereto. The barrier may be used in conjunction with one or more sensors that are each capable of detecting metallic objects. In response to determining that a metallic object does not satisfy one or more access parameters, the barrier may be caused to block access to the secured area. The one or more sensors may be in communication with a logic controller that permits a user at a human-machine interface to reset or reconfigure each of the one or more sensors.

19 Claims, 6 Drawing Sheets

(56) References Cited

U.S. PATENT DOCUMENTS

| | | | | |
|---|---|---|---|---|
| 2013/0117078 | A1 | 5/2013 | Weik, III et al. | |
| 2015/0259965 | A1* | 9/2015 | Tehranchi | E05F 15/632 49/31 |
| 2016/0148504 | A1 | 5/2016 | Fitzgibbon | |
| 2016/0254697 | A1 | 9/2016 | Tanaka et al. | |
| 2017/0080785 | A1 | 3/2017 | Azarko | |
| 2017/0200322 | A1 | 7/2017 | Baker, Sr. | |
| 2017/0321385 | A1 | 11/2017 | Marabyan et al. | |
| 2017/0372544 | A1 | 12/2017 | Schlechter et al. | |
| 2018/0030771 | A1 | 2/2018 | Washeleski et al. | |
| 2018/0222741 | A1 | 8/2018 | Cox et al. | |
| 2018/0260633 | A1 | 9/2018 | Madden et al. | |
| 2020/0043329 | A1* | 2/2020 | O'Callaghan | G08G 1/056 |

* cited by examiner

SYSTEMS AND METHODS FOR MONITORING ACCESS TO A SECURED AREA

CROSS REFERENCE TO RELATED APPLICATION

This application claims priority to provisional U.S. Application No. 62/650,867, filed Mar. 30, 2018, which is herein incorporated by reference in its entirety.

BACKGROUND

Monitoring access to a secured area can be achieved using a variety of equipment configurations. At entry points to secured areas where vehicles travel, a typical configuration may include one or more sensors near an entry point in communication with a logic unit. The logic unit, using data received from the sensors, can determine when a metallic object, such as a vehicle, is present.

If a metallic barrier is being used, and if it is of sufficient mass to be detectable by the sensors, then the logic unit may report false positives when the metallic barrier opens or closes. Additionally, sensors can occasionally transmit anomalous signals that may cause false positives and/or inaccurate detection. With existing systems known in the art, reconfiguring or resetting a sensor in response to receiving false alarms and/or anomalous signals typically cannot be done without expert assistance. Further, existing systems simply detect an object as being present or not, rather than detecting an object's presence as well as continuously receiving data to ascertain attributes of the object. These and other shortcomings are addressed by the systems and methods described herein.

SUMMARY

It is to be understood that both the following general description and the following detailed description are exemplary and explanatory only and are not restrictive. Provided are systems and methods for monitoring access to a secured area.

In an aspect, monitoring access to a secured area may include a plurality of sensors used to detect when metallic objects, such as vehicles, are proximate to an entry point to the secured area. Once an object is detected, the plurality of sensors continue capturing data which is used to determine physical attributes of the object in real time. An example sensor that may be used is an inductive-loop sensor, which can determine a frequency signature of a metallic object within an electromagnetic field that is created by electrical current flowing through one or more coils of conductive material connected to the sensors. In some examples, three sensors are used, and the coils of conductive material may be situated at various locations on a roadway near the entry point. The sensors may be in communication with a control unit, such, for example, a programmable logic unit, which can receive data from the sensors as well as reconfigure the sensors. Additionally, a moveable barrier situated at the entry point may be used to block entry to the secured area and/or provide access to the secure area through the entry point. For example, the barrier could be used to block a vehicle from entering if it does not meet access parameters, such as a maximum vehicle size. Further, if the barrier is metallic, the control unit may also be configured to disregard the barrier's signature (e.g., a detected change in electrical current that is indicative of the barrier) when it is received from one or more of the sensors such that other metallic objects that may come within proximity of the entry point can be detected and analyzed. The control unit in communication with the programmable logic unit, or the control unit and the programmable logic unit may be a single unit. With the control unit, a user can reset one or more of the sensors if, for example, errors are being reported. The user can also reconfigure one or more settings of one or more of the sensors, such as a sensor's sensitivity to metallic objects of a specific mass (e.g., sensitivity adjusted to disregard a metallic barrier). Additionally, with the control unit, the user can multiplex one or more sensor's output in order to overcome signals that may be determined to be crossed. Additionally, anomalous signals received from one or more of the sensors may be qualified by the control unit such that the anomalous signal is disregarded for a certain period of time when certain object signatures (e.g., data received indicating a specific change or changes in the electrical current).

In a further aspect, a method of monitoring access to a secured area may be implemented. The method may include using one or more inductive-loop sensors, which can be in communication with a programmable logic unit, to detect when a metallic object, such as a vehicle, is within proximity of a barrier situated at an entry point to the secured area. Further, the programmable logic unit, using data provided by the sensors, may determine physical characteristics and/or a velocity of the metallic object. The physical characteristics and/or velocity may be used by the programmable logic unit when determining whether the metallic object, such as a vehicle, may enter the secured area. In some examples, the programmable logic unit is in communication with, or is part of, a control unit, which can permit a user to reconfigure one or more of the sensors (e.g., adjust a sensitivity of one or more the sensors) or to reset one or more of the sensors.

Additional advantages will be set forth in part in the description which follows or may be learned by practice. The advantages will be realized and attained by means of the elements and combinations particularly pointed out in the appended claims.

BRIEF DESCRIPTION OF THE DRAWINGS

The accompanying drawings, which are incorporated in and constitute a part of this specification, illustrate embodiments and together with the description, serve to explain the principles of the systems and methods.

DETAILED DESCRIPTION

Figure 1:
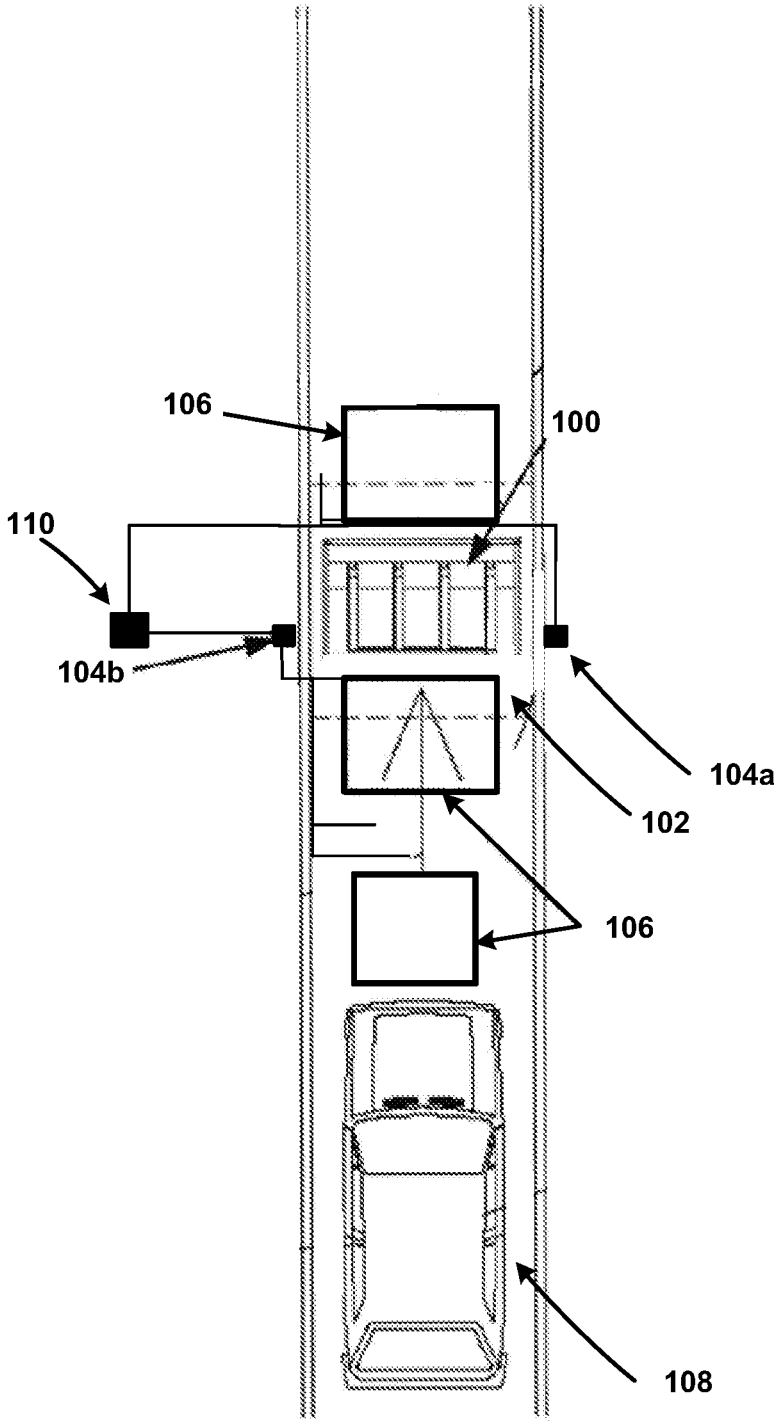
FIG. 1 is a diagram of an exemplary monitoring system.

Before the present systems and methods are disclosed and described, it is to be understood that the systems and methods are not limited to specific methods, specific components, or to particular implementations. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed systems and methods. These and other components are disclosed herein, and it is understood that when combinations, subsets, interactions, groups, etc., of these components are disclosed that while specific reference of each various individual and collective combinations and permutations of these may not be explicitly disclosed, each is specifically contemplated and described herein, for all systems and methods. This applies to all aspects of this disclosure including, but not limited to, steps in disclosed methods. Thus, if there are a variety of additional steps that can be performed it is understood that each of these additional steps can be performed with any specific embodiment or combination of embodiments of the disclosed methods. The present systems and methods may be understood more readily by reference to the following detailed description of preferred embodiments and the examples included therein and to the Figures and their previous and following description.

As will be appreciated by one skilled in the art, the systems and methods may take the form of an entirely hardware embodiment, an entirely software embodiment, or an embodiment combining software and hardware aspects. Furthermore, the systems and methods may take the form of a computer program product on a computer-readable storage medium having computer-readable program instructions (e.g., computer software) embodied in the storage medium. More particularly, the present systems and methods may take the form of specialized computer software executed by a processor of a computer, connected by wired or wireless means to a closed network, that is in communication with a programmable logic unit. Any suitable computer-readable storage medium may be utilized including hard disks, CD-ROMs, optical storage devices, or magnetic storage devices.

Embodiments of the systems and methods are described below with reference to block diagrams and flowchart illustrations of methods, systems, apparatuses and computer program products. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus, such as, for example, a programmable logic unit, to produce a machine, such that the instructions which execute on the computer or other programmable data processing apparatus create a means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

Disclosed herein are systems and methods for monitoring access to a secured area. With an example system, metallic objects, such as vehicles, entering or exiting a secured area can be monitored by a plurality of sensors, such as inductive-loop sensors, that are situated adjacent to an entry point to the secured area. The sensors may be interconnected by a conductive material, such as copper wiring forming one or more loops, and they may be configured by a programmable logic unit in communication with the sensors. The sensors can be configured by the programmable logic unit to collect data relating to one or more physical characteristics and/or movement of a metallic object, including, for example, a mass, a length, width, height, weight, and a velocity of the metallic object. Additionally, along with the sensors and the programmable logic unit, a barrier situated at the entry point may be used to control access to the secured area. The barrier may be moveable, such as an arm-type barrier, a door, a slide gate, a bi-fold gate, a swing gate, a wedge, or the like. The programmable logic unit can be configured to cause the barrier to block access to the secured area when a metallic object, such as a vehicle, is near the entry point and does not satisfy a predetermined set of access parameters. The access parameters can be stored on a memory of the programmable logic unit, and they may include, by way of example, one or more acceptable physical characteristics and/or one or more acceptable velocities of metallic objects that are detected (e.g., only vehicles of a certain size may enter the secured area). If the barrier being used is metallic and is of sufficient mass to be detected by the sensors, the sensors can further be configured by the programmable logic unit to disregard the barrier and still be capable of detecting other metallic objects that may come within proximity of the entry point.

Notwithstanding the programmable logic unit's capacity to adjust detection sensitivity for one or more of the sensors to account for a barrier of large mass, additional adjustments may be necessary (e.g., customizing detection sensitivity to fit a particular installment configuration of the sensors; troubleshooting errors and/or anomalous signals received; modifying access parameters; and the like). To make such adjustments to monitoring systems known the art, it is usually required that either the sensors be taken out of service and adjusted by physical means, or the adjustments are made using a portable computing device and proprietary software. For example, a technician for a manufacturer of the sensors would have to connect to the control device (e.g., a programmable logic unit or a control unit in communication with a programmable logic unit) with a laptop or similar portable computer and then use manufacturer-owned software to make the necessary adjustments. As one skilled in the art can appreciate, the need for outside assistance when making adjustments or correcting faults can be cumbersome, time-consuming, and expensive.

In contrast to the monitoring systems known the art, the systems described herein permit customization of the access parameters as well as adjusting, or correcting the operation of, the various sensors without the need for outside assistance (e.g., a manufacturer's technician). This can be accomplished by the use of a control unit in communication with the programmable logic unit that receives a continuous of data from the sensors. The control unit may comprise specialized instructions stored on a memory of the control unit that, when executed by a processor of the control unit, can cause the control unit to take action automatically in response to a given operational situation that is determined based on certain data received from one or more the sensors (e.g., causing the barrier to block the entry point upon the detection of a metallic object of a certain length). Alternatively, or in addition, the control unit may comprise a human-machine interface (e.g., a touchscreen computer), thereby allowing a user to adjust or to reset one or more of the sensors. A reset of one or more of the sensors may be required if one or more of the sensors is transmitting an anomalous signal, failing to detect an object, reporting false alarms, and the like. An anomalous signal may be a result of, for example, signal interference, intermittent bursts of electromagnetic interference, and so forth. A signal may be determined to be anomalous when the programmable logic unit and/or the control unit receives incongruous data from the sensors. For example, one or more of the sensors may indicate that a metallic object is present while one or more other sensors do not (e.g., a sensor that is closest to a metallic barrier of sufficient mass to be detected by the sensor may continuously detect the barrier's movement).

The control unit may also be used to reconfigure one or more of the sensor's settings. As an example, a reconfigurable setting may be a sensor's sensitivity to metallic objects of a certain mass. This could allow the user to change a sensor's base sensitivity used when determining that a metallic object is present in order to disregard movement of a metallic barrier being used to control access to the secured area. As another example, one or more of the sensors may be located near a metallic barrier that is immovable, such as an iron gate or metal fencing, and the base sensitivity of the one or more sensors could be adjusted so that the barrier is not detected. Other adjustable settings can include, but are not limited to, altering a base frequency a sensor uses as a threshold and/or trigger when detecting an object, as well as multiplexing one or more sensor's outputs to overcome signals that may be crossed. Additionally, an anomalous signal may be qualified by the programmable logic unit and/or the control unit such that the anomalous signal is disregarded for a certain period of time and/or when certain object signatures are received (e.g., data received indicating a specific change or changes in the electrical current). For example, a signature indicative of a bicycle may be received and then qualified by the programmable logic unit and/or the control unit such that the bicycle is not considered by the programmable logic unit and/or the control unit as a metallic object requiring analysis in order to ascertain whether it meets access parameters required for entry (e.g., bicycles may never be allowed to enter the secured area, regardless of size, speed, etc.).

In addition to the example system described above, a method may be used to monitor access to a secured area. The method may call for using one or more sensors that are in communication with a programmable logic unit to detect when a metallic object is near a barrier situated at an entry point to the secured area. The sensors may be a variety of sensors that can detect metallic objects as well as provide a continuously flow of data to the programmable logic unit which is used to determine one or more physical attributes of the metallic object. For example, inductive-loop sensors with loops of conductive material located adjacent to the entry point and in communication with the sensors may be used. The sensors may be capable of providing data indicating a change in an electrical current that is flowing through the conductive material. The electrical current may change in response to a metallic object passing nearby and/or over the conductive material, and the relative change in electrical current over a period of time can be used when determining the one or more physical attributes of the metallic object (e.g., the change in electrical current over time may vary based on a shape, length, etc. of the metallic object).

Further, the programmable logic unit, using the continuous flow of data provided by the sensors, may be capable of determining physical characteristics and/or a velocity of a detected metallic object, such as a vehicle seeking entry to the secured area. The programmable logic unit may determine whether the vehicle can enter the secured area based on the data received from the sensors as well as a set of access parameters stored on a memory of the programmable logic unit. If the vehicle does not satisfy the access parameters, then the programmable logic unit may cause the barrier to block the metallic object from passing through the entry point. On the other hand, if the predetermined set of access parameters are met, then the programmable logic unit may cause the barrier to change its position such that the metallic object may pass over the barrier and through the entry point. In examples where the barrier being used is metallic, the sensors can be further configured to disregard the barrier's movement and to detect other metallic objects that may come within proximity of the entry point (e.g., the metallic barrier is of sufficient mass to be detected by one or more of the sensors).

In some examples, the programmable logic unit can reset and/or reconfigure one or more of the sensors using specialized software stored on a memory of the programmable logic unit. In other examples, similar to the example systems discussed above, a user (e.g., security guard; employee; custodian; law enforcement personnel; or the like) can reconfigure the sensors and/or the barrier at a control unit (e.g., touchscreen computer; a tablet; a mobile device; and the like) that is in communication with the programmable logic unit. For example, a setting of a sensor that could be reconfigured is a sensor's base sensitivity to metallic objects of a given mass. Adjusting this setting may prevent one or more of the sensors from reporting false positives in response to a metallic barrier moving into or out of a certain position and/or metallic object of insignificant size such as garbage, debris, etc. that may pass over or nearby a sensor's conductive loop(s). This could allow for the sensors to continue monitoring for metallic objects despite the barrier's movement and/or the garbage, debris, etc. The control unit may also be used to reset one or more of the sensors when the programmable logic unit receives data indicating a divergent change in an electrical current from one or more of the sensors. This can be referred to a "hung" sensor, and the user, with the control unit, can reset the hung sensor and/or adjust one or more of the sensor's settings (e.g., altering a base frequency a sensor uses as a threshold and/or a trigger when detecting an object, multiplexing one or more sensor's outputs to overcome signals that may be crossed, etc.). Additionally, the data indicating a divergent change in an electrical current received from one or more of the sensors may be qualified by the programmable logic unit and/or the control unit such that the data is disregarded for a certain period of time and/or when certain object signatures (e.g., changes in electrical current) are received. While the aforementioned example described that control unit as being a separate device from the programmable logic unit, it is to be understood that the control unit and the programmable logic unit may be a single device that is in communication with a human-machine interface (e.g., a touch-screen computer; a tablet; a mobile device; and the like) which may be designed or programmed to allow a user without expert training to reconfigure the sensors and/or the barrier (e.g., the user can interact with the human-machine interface through a graphical user interface rather than a coding terminal).

When a metallic object is detected, the programmable logic unit may increment a number stored in its memory that may represent a number of metallic objects that have passed through the entry point during a specific interval. Additionally, when a metallic object is detected, the programmable logic, using data continuously received from one or more of the sensors, may be able to ascertain that the metallic object is approaching the entry point at a rapid speed (e.g., the object is detected at a first sensor 100 feet from the entry point and subsequently detected 1 second later by an additional sensor only 25 feet from the entry point). If the speed is such that it exceeds a predetermined access parameter (e.g., less than 10 miles per hour), the programmable logic may cause a warning to display on a screen or other interface in communication with the control unit so as to alert the user of the metallic object's speed. As another example, additional sensors may be situated near an exit point from the secured area, and a metallic object may be determined to be approaching the entry point from an improper direction (e.g., the object is detected as moving through a sensor's conductive loop(s), situated at an exit lane outside the secured area, in a direction toward the secured area). In such an example, a wrong-way warning may be displayed at the control unit so the user may take necessary action (e.g., cause a barrier of the exit lane to immediately block the object's entry into the secured area; notify security personnel; cause an alarm or siren at the secured area to activate, etc.).

Turning now to FIG. 1, an example configuration of a monitoring system is depicted. A barrier 100 can be placed at an entry point 102 to a secured area in order to control vehicular access to the secured area. A plurality of sensors 104*a,b* can be situated proximate to the barrier 100 and the entry point 102. The plurality of sensors 104*a,b* may be, for example, inductive-loop sensors that can detect metallic objects passing over or nearby one or loops of conductive material 106, such as copper wiring, located on one or more sides of the entry point 102. Using the plurality of sensors 104*a,b* and the conductive material 106, a programmable logic unit 110, which can be in communication with the plurality of sensors 104*a,b* by wired or wireless means, can determine when a metallic object is proximate to the entry point 102. For example, a metallic object may be a vehicle 108. In addition to detecting that the vehicle 108 is near the entry point 102, the plurality of sensors 104*a,b* can also collect a continuous stream of data relating to one or more physical attributes and/or movement of vehicle 108. Such physical attributes may include, for example, a mass, a length, width, height, and/or weight of the vehicle 108, and the movement may be a velocity of the vehicle 108. For example, if the plurality of sensors 104*a,b* are inductive-loop sensors, then the various changes in electrical current can be determined by a change in resonant frequency as a metallic object approaches a loop-induction sensor. Metallic objects with similar physical attributes (e.g., a certain model or type of car, truck, or van) will cause similar changes in resonant frequency (e.g., an object's frequency signature). The frequency signature can enable the monitoring system, using the continuous stream of data collected by the plurality of sensors 104*a,b* and a control unit—discussed below—to determine the physical attributes of the detected metallic object.

Further, the programmable logic unit 110 can comprise a memory on which a plurality of access parameters may be stored, which can be used by the programmable logic unit 110 when determining whether a metallic object, such as vehicle 108, is authorized to enter the secured area. The plurality of access parameters may include, among other things, groups of frequency signatures for various types and models of vehicles, physical attributes that are acceptable for vehicles entering the secured area (e.g., height, length, model, type, etc.), times of day where access is limited or denied (e.g., no nighttime access), a number of detected vehicles over a given period of time (e.g., 100 vehicles are detected in 3 hours), object velocities (e.g., a speed and/or a directions of travel), and the like. For example, vehicle 108 may be determined by the programmable logic unit 110, based on the continuous stream of data provided by the plurality of sensors 104*a,b* as well as the plurality of access parameters, to be thirty feet long, and a certain parameter of the plurality of access parameters may indicate that fifteen feet is a maximum length for vehicles entering the secured area. As another example, the vehicle 108 may be determined by the programmable logic unit 110 to be approaching the entry point 102 at a speed that is above a threshold speed parameter among the plurality of access parameters. Consequently, in both examples, the programmable logic unit 110 may determine that entry of the vehicle 108 is not authorized. The barrier 100 may be a moveable barrier, such as an arm-type barrier, a door, a slide gate, a set of bi-fold gates, a set of swing gates, a wedge, or the like. In both examples, after determining that the vehicle 108 is not authorized to enter the secured area, the programmable logic unit 110 may cause the barrier 100 to block the vehicle 108 from entering the secured area. In another example, if physical attributes of a vehicle 108 are determined to satisfy the plurality of access parameters (e.g., appropriate size, speed, etc.), then the programmable logic unit 110 may cause the barrier 100 to move to a position such that the vehicle 108 can pass through the entry point 102 and into the secured area.

If the barrier 100 is metallic and is of sufficient mass and/or metallic surface area as to be detectable by one or more of the plurality of sensors 104*a,b*, then the plurality of sensors 104*a,b* may further be configured by the programmable logic unit 110 (or a control unit) to disregard the barrier's 100 presence and/or movement (e.g., a base frequency of one or more sensors of the plurality of sensors 104*a,b* can be adjusted such that the one or more sensors will not provide data indicative of a metallic object being present). This could allow for the plurality of sensors 104*a,b* to successfully detect when an additional metallic object, other than the barrier 100, comes within proximity of the entry point 102 (e.g., a sensor that is closest to a barrier may have an adjusted base frequency in order to disregard the barrier while another sensor may have a more sensitive base frequency).

As discussed in the sections above with regard to the example systems and methods described, notwithstanding the programmable logic unit's 110 capacity to adjust detection sensitivity for one or both of the plurality of sensors 104*a,b* to account for a large barrier 100, additional adjustments may be necessary (e.g., customizing detection sensitivity to fit a particular installment configuration of the sensors 104*a,b*; troubleshooting errors and/or faults in the monitoring system; modifying access parameters; and the like). As previously noted, to make such adjustments on monitoring systems known the art, it is usually necessary that either the detection sensors (e.g., sensors 104*a,b*) be taken out of service and adjusted by physical means, or the adjustments are made using a portable computing device and proprietary software. For example, a technician for a manufacturer of the sensors would have to connect to the programmable logic unit (e.g., programmable logic unit 110) with a laptop or similar portable computer and then use manufacturer-owned software to make the necessary adjustments. As one skilled in the art can appreciate, the need for outside assistance when making adjustments or correcting faults can be cumbersome, time-consuming, and expensive.

In contrast to the monitoring systems known the art, the monitoring system depicted in FIG. 1 can facilitate customization of the access parameters as well as adjusting, or correcting the operation of, the plurality of sensors 104*a,b* without the need for outside assistance (e.g., a manufacturer's technician). This can be accomplished by the use of a control unit in communication with the programmable logic unit 110 by wired or wireless means. Optionally, the programmable logic unit 110 and control unit are a combined unit. The control unit may comprise specialized software and a plurality of access parameters stored on a memory of the control unit that are used to make certain adjustments automatically in response to a given operational situation. For example, the sensors 104*a,b* may provide data to the control unit, via the programmable logic unit 110, which is used by the control unit to determine that a detected metallic object is a vehicle having a certain length that exceeds an access parameter, and consequently the control unit causes the barrier 100 to block the vehicle from entering the secured area. In another example, the control unit may disregard data received from one or more of the sensors 104*a,b* (e.g., the control unit may determine that a sensor is providing an anomalous signal, and in response the control unit may disregard data received from that particular sensor while continuing to monitor and analyze data received from other sensors). Alternatively, or in addition, the control unit may comprise a human-machine interface that can facilitate user interaction with the control unit (e.g., and by extension the programmable logic unit 110). For example, the control unit may make automatic adjustments or take certain actions automatically based on the software and access parameters stored on the memory, or a user at a human-machine interface (e.g., computer, tablet, mobile device, etc., that is in communication with the control unit by wired or wireless means) may direct the control unit to take certain actions (e.g., open or close a barrier; adjust or reconfigure a sensor; update the access parameters, etc.).

Figure 2A:
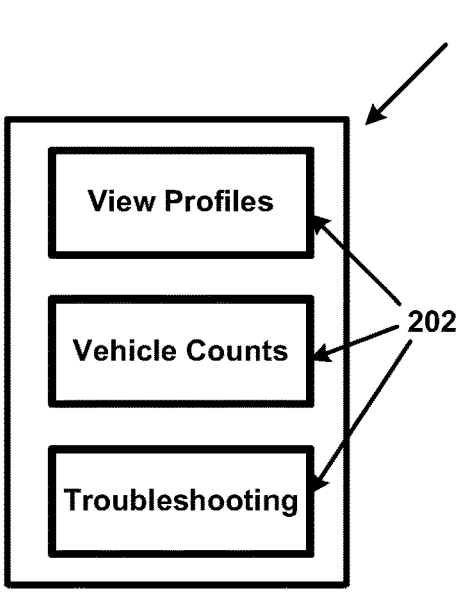
FIG. 2A is a view of an exemplary control unit.
Figure 2B:
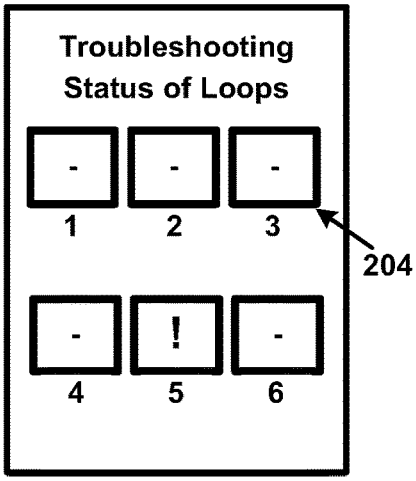
FIG. 2B is a view of an exemplary control unit.
Figure 2C:
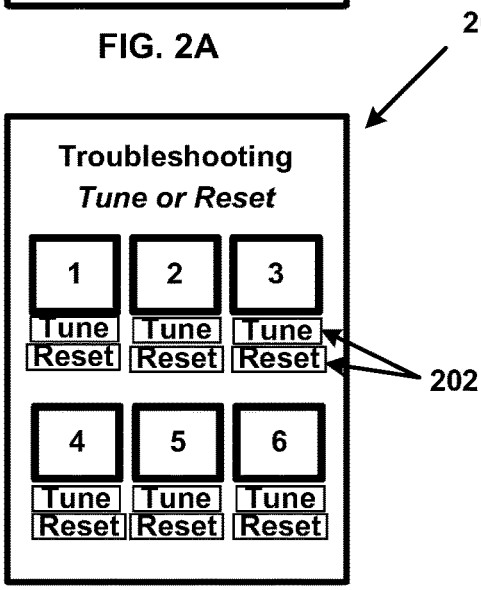
FIG. 2C is a view of an exemplary control unit.
Figure 2D:
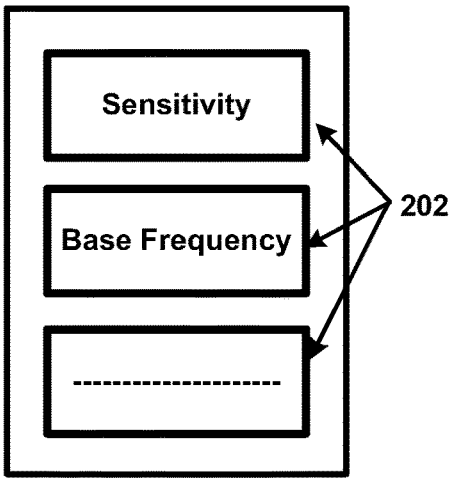
FIG. 2D is a view of an exemplary control unit.
Figure 2E:
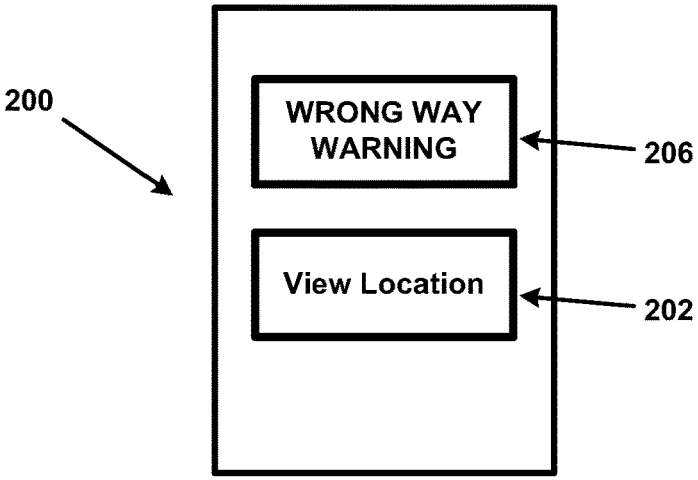
FIG. 2E is a view of an exemplary control unit.

FIGS. 2A-2E depict several example user interfaces that may be displayed by a control unit 200 (e.g., via a human-machine interface that is in communication with, or a part of, the control unit 200). In some examples, the control unit 200 may facilitate user interaction with a touchscreen human-machine interface (e.g., a touchscreen computer; tablet; mobile device; or the like). FIG. 2A shows a graphical user interface (GUI) of three touchscreen buttons 202 that can be pressed to proceed to various other displays (e.g., View Profiles, Vehicle Counts, and/or Troubleshooting), thereby allowing a user without expertise or technical training to interact with the control unit 200 and to troubleshoot or adjust the plurality of sensors 104*a,b*. FIG. 2B depicts a troubleshooting screen that can display the current status of one or more inductive-loop sensors that are part of the system 100. In an example, as shown by FIG. 2B, loop number 5 may be transmitting data indicative that a metallic object is present while loops 1-4 and 6 are not (e.g., loop number 5 is transmitting an anomalous signal). FIG. 2C shows a user interface that can allow the user to tune and/or reset one or more of a loop's sensors. For example, an anomalous signal may be received from one or more of a loop's sensors by the control unit 200, via the programmable logic unit 110. The anomalous signal may comprise incongruous data received from one or more sensors of the plurality of sensors 104*a,b*, and it may be a result of, for example, signal interference, intermittent bursts of electromagnetic interference, and so forth. As shown by FIG. 2C, the user can reset one or more of the loop's sensors in order to overcome the anomalous signal (e.g., power cycle one or more of the loop's sensors). Additionally, as shown in FIG. 2D, the user can tune one or more of the loop's sensors in order to adjust, for example, a sensor's detection sensitivity or base frequency used as a threshold and/or trigger when detecting an object. As another example, the user may wish to reconfigure the plurality of sensors 104*a,b* to disregard a barrier 100 that may be of sufficient mass as to be detected by the plurality of sensors 104*a,b* and cause false alarms to be reported. Tuning may also include multiplexing one or more sensors' 104*a,b* outputs to overcome signals that may be crossed. Further, the control unit 200 can allow the programmable logic unit 110 to be tuned such that an anomalous signal may be qualified in such a way to be disregarded for a certain period of time and/or when certain frequency signatures are received (e.g., if motorcycles are not permitted to enter the secured area, then the control unit 200 may not cause a barrier to permit access for a detected object when a frequency signature of the object is indicative of a motorcycle). FIG. 2E depicts an example where a metallic object, such as a vehicle 108, has been detected by the plurality of sensors 104*a,b* moving toward the entry point 102 from within the secured area at an improper direction (e.g., attempting to exit through an entry lane). In such an example the control unit 200 may display a "wrong way" warning 206 to the user. In response the user could press button 202 in order to view the location within the secured area that the vehicle 108 is moving (e.g., using one or more security cameras installed proximate to the entry point 102 and providing video streams to the control unit 200).

Figure 3:
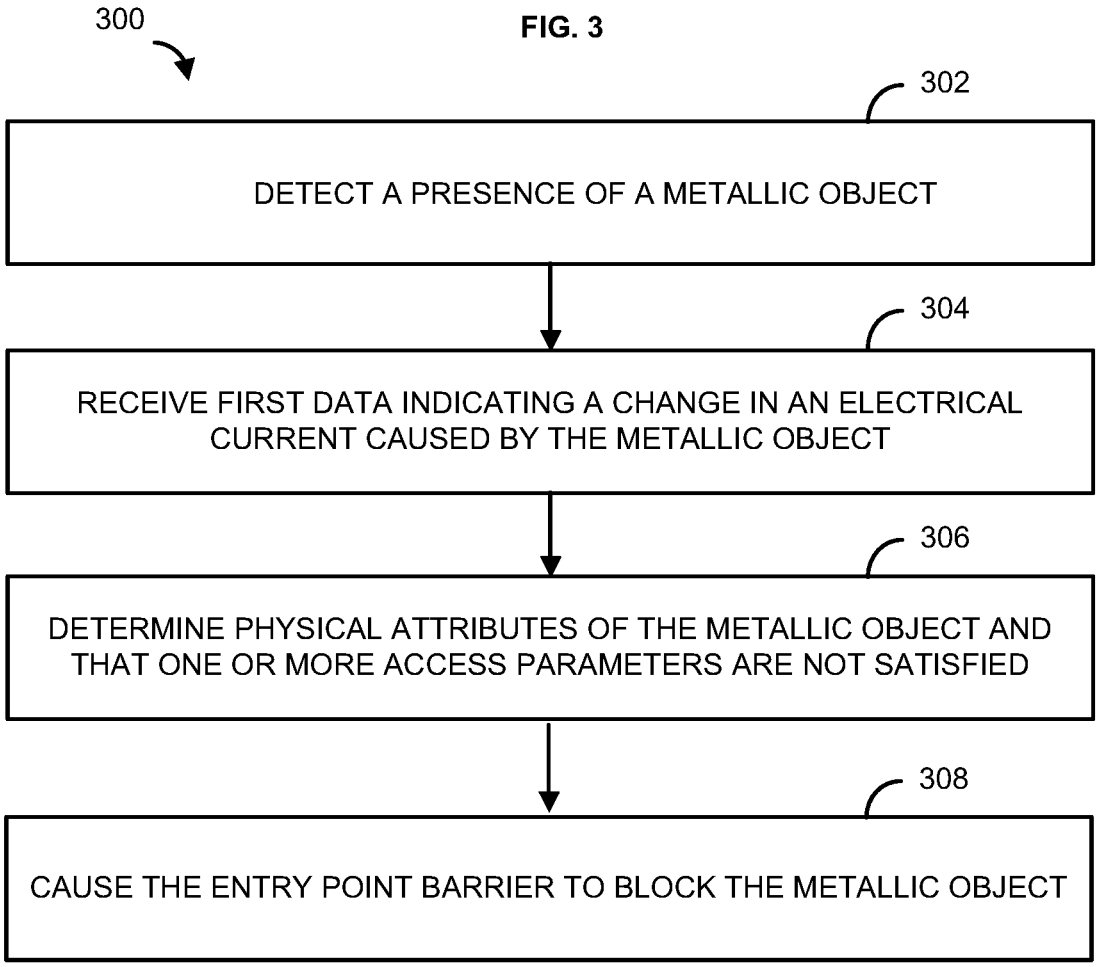
FIG. 3 is a flowchart of an exemplary method.

Turning now to FIG. 3, method 300 may be used to monitor access to a secured area. The method begins at step 302, where a metallic object proximate to an entry point barrier can be detected by a plurality of sensors, which are connected to a logic unit. In some examples, the plurality of sensors may be inductive-loop sensors, which can detect when a metallic object passes over loops of conductive material, such as copper wiring. To detect when metallic objects are proximate to the entry point, the loops may be located adjacent to an entry point barrier and configured to provide a continuous stream of data (e.g., changes in electrical current detected by the sensors) to the logic unit. At step 304 data can be received at the logic unit from the plurality of sensors indicating a certain change in an electrical current that is flowing through the conductive material connected to the plurality of sensors (e.g., a frequency signature). The electrical current may change in response to a metallic object passing nearby and/or over the conductive material (e.g., a vehicle is approaching the entry point barrier). At step 306, the logic unit, using the data provided by the sensors, can determine physical characteristics (e.g., mass, height, length, weight, etc., of an approaching vehicle) of the detected metallic object, and at step 308 the logic unit, using data provided by the sensors, can determine one or more physical attributes of the metallic object (e.g., an approaching vehicle's speed and/or direction) The logic unit may also determine that one or more access parameters are not satisfied based on the one or more physical attributes of the metallic object.

In some examples, a set of predetermined access parameters may be stored on a memory of the logic unit. The logic unit may cause the barrier to block the metallic object, such as a vehicle, from passing through the entry point if the vehicle that does not satisfy one or more access parameters of the predetermined set of access parameters. For example, the vehicle may be determined by the logic unit to be thirty feet long, and an access parameter of the predetermined access parameters may indicate that fifteen feet is a maximum length for vehicles entering the secured area. As another example, the vehicle may be determined by the logic unit to be approaching the entry point at a speed that is above a threshold access parameter among the predetermined set of access parameters. As a third example, the vehicle may be determined by the logic unit, using the predetermined access parameters, to be the forty-first metallic object to have passed through the entry point in the past hour, and one of the access parameters of the predetermined access parameters may set a threshold of only forty vehicles per hour that can pass through the entry point. Consequently, in all three examples, the logic unit may determine that entry of the vehicle is not authorized. On the other hand, if one or more access parameters of the predetermined set of access parameters are met, then the logic unit may cause the barrier to change its position such that the metallic object may pass through the entry point and into the secured area.

Figure 4:
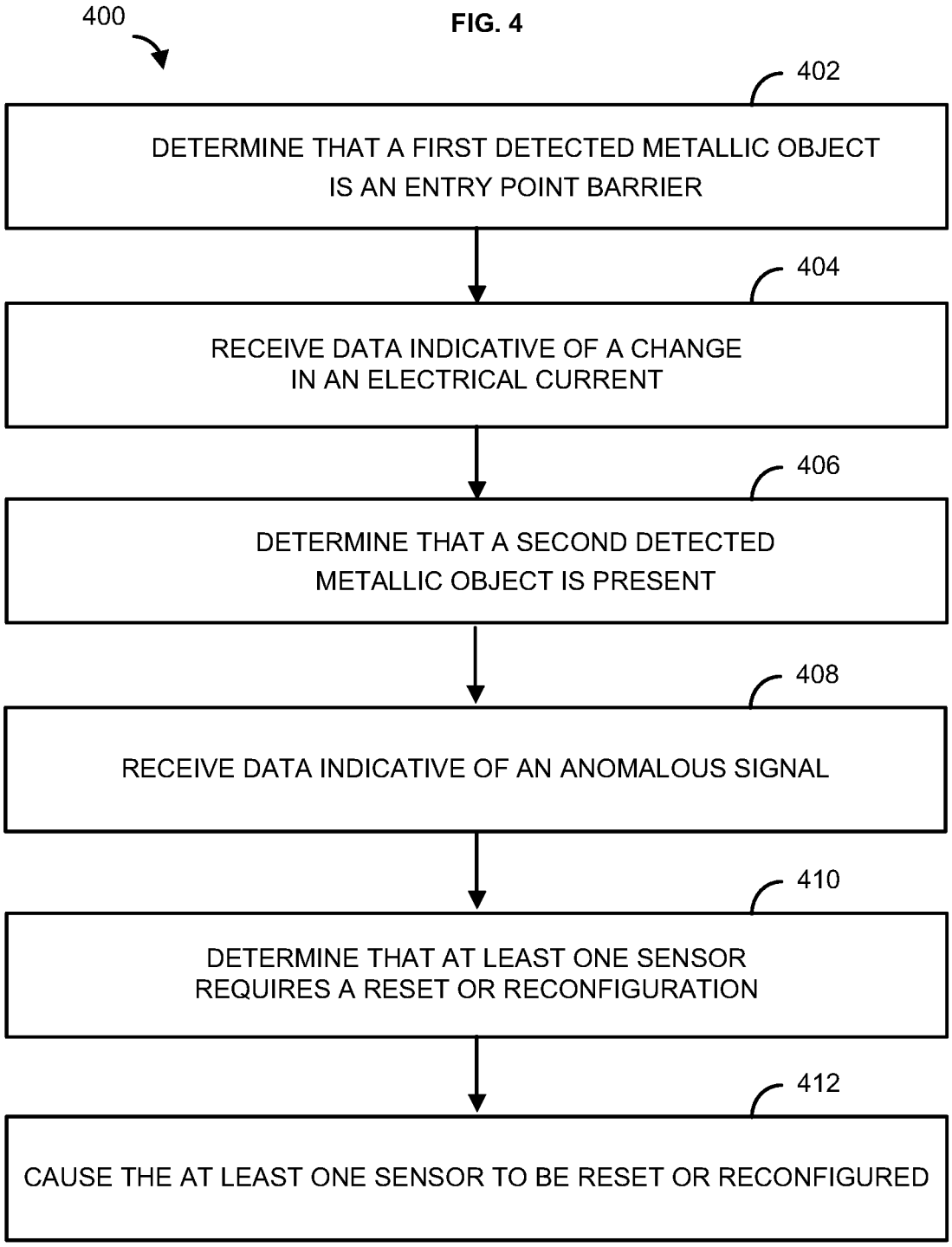
FIG. 4 is a flowchart of an exemplary method.

Turning to FIG. 4, method 400 can be an extension of method 300. At step 402, the logic unit may determine that the barrier is metallic. In this case, the one or more sensors of the plurality of sensors can be further configured to disregard the barrier's presence (e.g., reconfigured such that the sensor's base frequency will not detect a non-moveable barrier) and/or movement (e.g., reconfigured such that the a moveable barrier's frequency signature does not cause the sensor to transmit data indicative of a metallic object being present when the barrier moves into the sensor's range of detection). At step 404, second data can be received from the plurality of sensors indicating a second change in the electrical current caused by a metallic object other than the barrier. At step 406, it can be determined that a second metallic object is present proximate to the entry point barrier based on the second data and a set of control data stored on the memory of the logic unit. The control data, for example, could include a frequency signature of the entry point barrier. Using the control data, the logic unit can determine whether a received frequency signature resulting from the second change in the electrical current is indicative of a second metallic object being present. As another example, the control data may include frequency signatures indicative of motorcycles. In such an example, one of the access parameters of the predetermined set of access parameters may exclude motorcycles from entering the secured area (e.g., the logic unit would not cause the barrier to provide access to approaching motorcycles).

At step 408, data may be received indicating an anomalous signal such as a divergent change in the electrical current detected by one or more of the plurality of sensors. In other words, one or more of the plurality of sensors may be indicating that a metallic object is present while the other sensors are not. At step 410, it can be determined, based on the data indicating the divergent change in the electrical current, that one or more of the sensors is "hung" or "latched." In such cases, at step 412 one or more of the plurality of sensors that is "hung" or "latched" may be reconfigured by the logic unit. An example reconfiguration could be as simple as resetting the sensor(s) with a power cycle. Reconfiguration could also include tuning the sensor (s) to have a different level of sensitivity to metallic objects (e.g., adjusting the sensor(s)'s base frequency). For example, a sensor that is closest to the moveable barrier may consistently cause a false alarm when it detects movement of the barrier. Adjusting that sensor's sensitivity may alleviate the false alarms and allow the sensor to continue functioning and more accurately detect metallic objects other than the barrier. Other reconfigurations can include, but are not limited to, the logic unit multiplexing one or more sensors' outputs to overcome signals that may be crossed. An additional reconfiguration that can be implemented in order to overcome an anomalous signal received from one or more sensors may include the logic unit qualifying the anomalous signal such that the anomalous signal is disregarded for a certain period of time and/or when certain object signatures are received (e.g., frequency signatures indicative of insignificantly sized metallic objects and/or abrupt and unexpected changes in the electrical current can be disregarded for a period of time).

Figure 5:
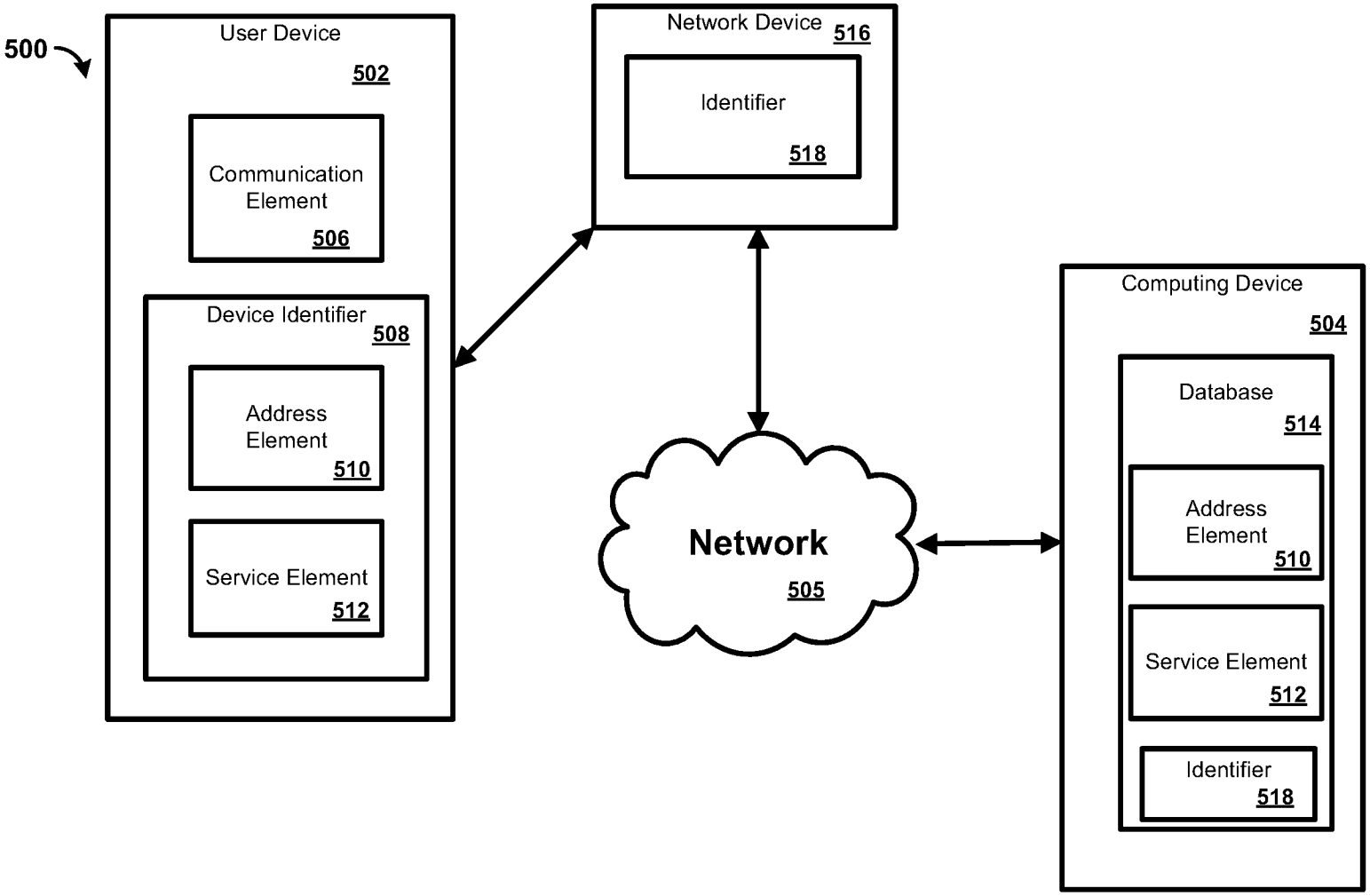
FIG. 5 is a block diagram of an exemplary user device.

The steps described in methods 300 and 400 may be accomplished using only the features described in the above description of the methods (e.g., the moveable barrier, plurality of sensors, conductive material, and the logic unit). Alternatively, or in addition, the determination and/or reconfiguration steps may be accomplished by a control unit (e.g., control unit 200) having a human-machine interface that is in communication with the control unit. FIG. 5 illustrates various aspects of an exemplary configuration and control system through which the present methods and systems can operate. As discussed above, the present disclosure is relevant to systems and methods for monitoring access to a secured area using a variety of equipment configurations (e.g., the barrier 100, the plurality of sensors 104*a,b*, the programmable logic unit 110, the control unit 200, and the like).

Those skilled in the art will appreciate that the present methods and systems may be used in various types of networks (e.g., a closed computer network) and systems that employ both digital and analog equipment. One skilled in the art will appreciate that provided herein is a functional description and that the respective functions can be performed by software, hardware, or a combination of software and hardware. As discussed above, the plurality of sensors and the barrier may be controlled solely by a logic unit (e.g., the programmable logic unit 110 and/or the control unit 200). Alternatively, or in addition, the logic unit may be in communication with a computing device 504. In such embodiments, the network and system can comprise a user device 502 (e.g., a human-machine interface) that is in communication with the computing device 504 and the logic unit (e.g., the programmable logic unit 110 and/or the control unit 200). The computing device 504 can be disposed locally or remotely relative to the user device 502. As an example, the user device 502 and the computing device 504 can be in communication via a private network 505 such as a local area network. Other forms of communications can be used such as wired and secured wireless telecommunication channels (e.g., an encrypted wireless network) for example. User device 502 may be a human-machine interface with a GUI such that a user can configure the logic unit (e.g., programmable logic unit 110 and/or control unit 200) through the computing device 504, which can act as an intermediary for communications sent to and received from the user device 502 and the logic unit. Optionally, the user device 502 may be integrated with the computing device 504 as a single unit (e.g., a computer; a tablet; a mobile device with a touchscreen; and the like).

The user device 502 can be an electronic device such as a computer, a smartphone, a laptop, a tablet, or other device capable of communicating with the computing device 504. As an example, the user device 502 can comprise a communication element 506 for providing an interface to a user to interact with the user device 502 and/or the computing device 504. The communication element 506 can be any interface for presenting and/or receiving information to/from the user, such as user feedback. An example interface may be communication interface such as a web browser (e.g., Internet Explorer®, Mozilla Firefox®, Google Chrome®, Safari®, or the like). Other software, hardware, and/or interfaces can be used to provide communication between the user and one or more of the user device 502 and the computing device 504. As an example, the communication element 506 can request or query various files from a local source and/or a remote source. As a further example, the communication element 506 can transmit data to a local or remote device such as the computing device 504.

The user device 502 can be associated with a user identifier or device identifier 508. As an example, the device identifier 508 can be any identifier, token, character, string, or the like, for differentiating one user or user device (e.g., user device 502) from another user or user device. The device identifier 508 can identify a user or user device as belonging to a particular class of users or user devices. As a further example, the device identifier 508 can comprise information relating to the user device such as a manufacturer, a model or type of device, a service provider associated with the user device 502, a state of the user device 502, a locator, and/or a label or classifier. Other information can be represented by the device identifier 508.

The device identifier 508 can comprise an address element 510 and a service element 512. The address element 510 can comprise or provide an internet protocol address, a network address, a media access control (MAC) address, an Internet address, or the like. As an example, the address element 510 can be relied upon to establish a communication session between the user device 502 and the computing device 504 or other devices and/or networks. As a further example, the address element 510 can be used as an identifier or locator of the user device 502. The address element 510 can be persistent for a particular network and can be used to identify or retrieve data from the service element 512, or vice versa. As a further example, one or more of the address element 510 and the service element 512 can be stored remotely from the user device 502 and retrieved by one or more devices such as the user device 502 and the computing device 504. Other information can be represented by the service element 512.

The computing device 504 can be a server for communicating with the user device 502. As an example, the computing device 504 can communicate with the user device 502 for providing data and/or services. As an example, the computing device 504 can provide services such as network (e.g., Internet) connectivity, network printing, media management (e.g., media server), content services, streaming services, broadband services, or other network-related services. The computing device 504 can allow the user device 502 to interact with remote resources such as data, devices, and files. The computing device 504 can manage the communication between the user device 502 and a database 514 for sending and receiving data therebetween. As an example, the database 514 can store a plurality of files (e.g., various access parameters to be stored on the memory of the programmable logic unit 110), user identifiers or records, or other information. As a further example, the user device 502 can request and/or retrieve a file from the database 514. The database 514 can store information relating to the user device 502 such as the address element 510 and/or the service element 512. As an example, the computing device 504 can obtain the device identifier 508 from the user device 502 and retrieve information from the database 514 such as the address element 510 and/or the service elements 512. As a further example, the computing device 504 can obtain the address element 510 from the user device 502 and can retrieve the service element 512 from the database 514, or vice versa. Any information can be stored in and retrieved from the database 514. The database 514 can be disposed remotely from the computing device 504 and accessed via direct or indirect connection. The database 514 can be integrated with the computing system 504 or some other device or system.

One or more network devices 516 can be in communication with a network such as network 505. As an example, one or more of the network devices 516 can facilitate the connection of a device, such as user device 502, to the network 505. As a further example, one or more of the network devices 516 can be configured as a wireless access point (WAP). One or more network devices 516 can be configured to allow one or more wireless devices to connect to a wired and/or wireless network using Wi-Fi, Bluetooth or any desired method or standard.

The network devices 516 can be configured as a local area network (LAN). As an example, one or more network devices 516 can comprise a dual band wireless access point. As an example, the network devices 516 can be configured with a first service set identifier (SSID) (e.g., associated with a user network or private network) to function as a local network for a particular user or users. As a further example, the network devices 516 can be configured with a second service set identifier (SSID) (e.g., associated with a public/community network or a hidden network) to function as a secondary network or redundant network for connected communication devices.

One or more network devices 516 can comprise an identifier 518. As an example, one or more identifiers can be or relate to an Internet Protocol (IP) Address IPV4/IPV6 or a media access control address (MAC address) or the like. As a further example, one or more identifiers 518 can be a unique identifier for facilitating communications on the physical network segment. Each of the network devices 516 can comprise a distinct identifier 518. As an example, the identifiers 518 can be associated with a physical location of the network devices 516.

Figure 6:
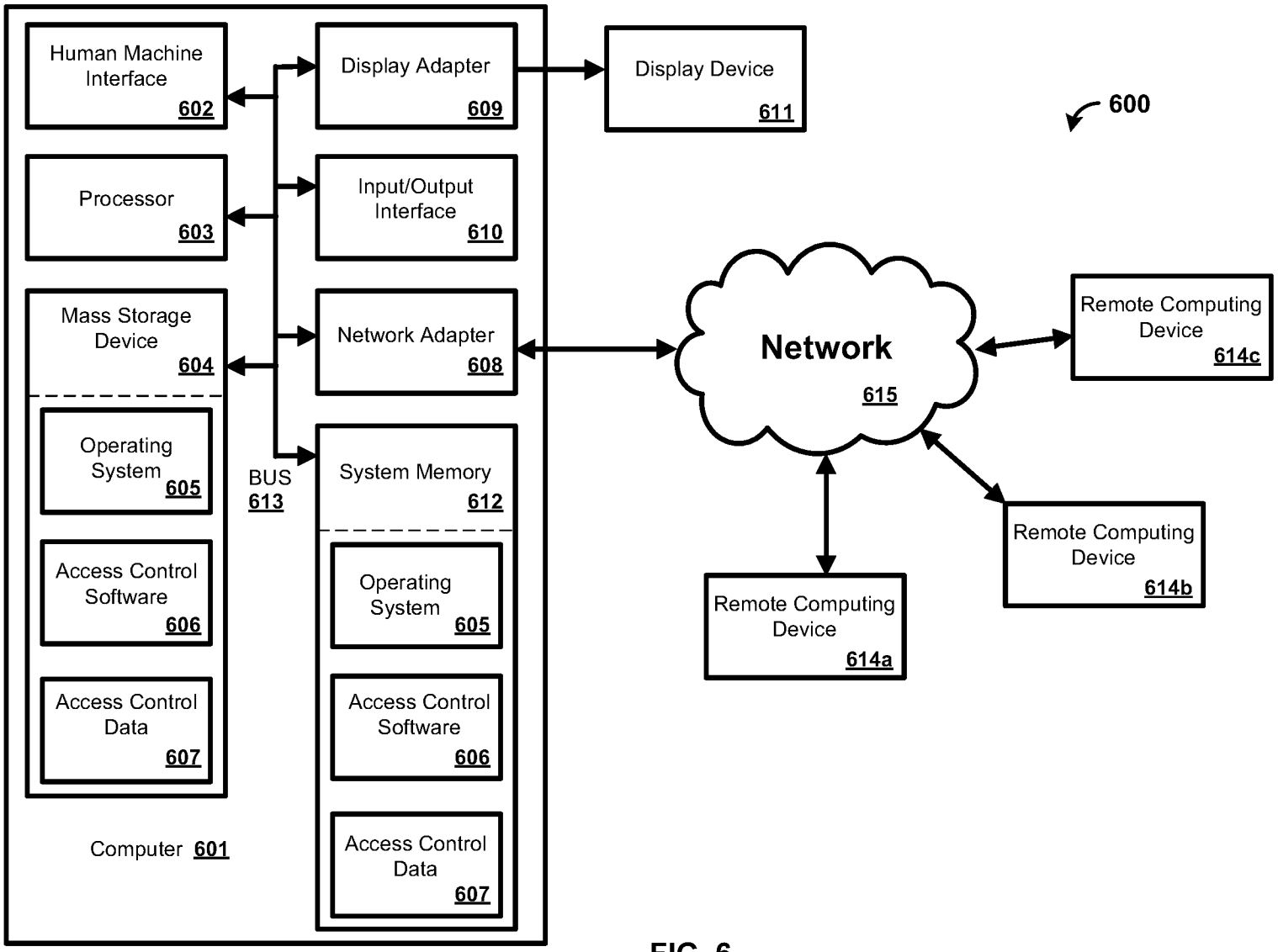
FIG. 6 is a block diagram illustrating an exemplary computing device.

In an aspect, the systems and methods can be implemented on a computer 601 as illustrated in FIG. 6 and described below. By way of example, the user device 502 of FIG. 5 (e.g., the human-machine interface in communication with the control unit 200—and by extension the programmable logic unit 110) can be a computer as illustrated in FIG. 6. Similarly, the systems and methods disclosed can utilize one or more computers to perform one or more functions in one or more locations. FIG. 6 is a block diagram illustrating an exemplary operating environment for performing the disclosed methods. This exemplary operating environment is only an example of an operating environment and is not intended to suggest any limitation as to the scope of use or functionality of operating environment architecture. Neither should the operating environment be interpreted as having any dependency or requirement relating to any one or combination of components illustrated in the exemplary operating environment.

The present systems and methods can be operational with numerous other general purpose or special purpose computing system environments or configurations. Examples of well-known computing systems, environments, and/or configurations that can be suitable for use with the systems and methods comprise, but are not limited to, personal computers, server computers, laptop devices, and multiprocessor systems. Additional examples comprise set top boxes, programmable consumer electronics, network PCs, minicomputers, mainframe computers, distributed computing environments that comprise any of the above systems or devices, and the like.

The processing of the disclosed systems and methods can be performed by software components. The disclosed systems and methods can be described in the general context of computer-executable instructions, such as program modules, being executed by one or more computers or other devices. Generally, program modules comprise computer code, routines, programs, objects, components, data structures, etc., that perform particular tasks or implement particular abstract data types. The disclosed methods can also be practiced in grid-based and distributed computing environments where tasks are performed by remote processing devices that are linked through a communications network. In a distributed computing environment, program modules can be located in both local and remote computer storage media including memory storage devices.

Further, one skilled in the art will appreciate that the systems and methods disclosed herein can be implemented via a general-purpose computing device in the form of a computer 601. The components of the computer 601 can comprise, but are not limited to, one or more processors 603, a system memory 612, and a system bus 613 that couples various system components including the one or more processors 603 to the system memory 612. The system can utilize parallel computing.

The system bus 613 represents one or more of several possible types of bus structures, including a memory bus or memory controller, a peripheral bus, an accelerated graphics port, or local bus using any of a variety of bus architectures. By way of example, such architectures can comprise an Industry Standard Architecture (ISA) bus, a Micro Channel Architecture (MCA) bus, an Enhanced ISA (EISA) bus, a Video Electronics Standards Association (VESA) local bus, an Accelerated Graphics Port (AGP) bus, and a Peripheral Component Interconnects (PCI), a PCI-Express bus, a Personal Computer Memory Card Industry Association (PCMCIA), Universal Serial Bus (USB) and the like. The bus 613, and all buses specified in this description can also be implemented over a wired or wireless network connection and each of the subsystems, including the one or more processors 603, a mass storage device 604, an operating system 605, access control software 606, access control data 607, a network adapter 608, the system memory 612, an Input/Output Interface 610, a display adapter 609, a display device 611, and a human machine interface 602, can be contained within one or more remote computing devices 614*a,b,c* at physically separate locations, connected through buses of this form, in effect implementing a fully distributed system.

The computer 601 typically comprises a variety of computer readable media. Exemplary readable media can be any available media that is accessible by the computer 601 and comprises, for example and not meant to be limiting, both volatile and non-volatile media, removable and non-removable media. The system memory 612 comprises computer readable media in the form of volatile memory, such as random access memory (RAM), and/or non-volatile memory, such as read only memory (ROM). The system memory 612 typically contains data such as the access control data 607 and/or program modules such as the operating system 605 and the access control software 606 that are immediately accessible to and/or are presently operated on by the one or more processors 603.

In another aspect, the computer 601 can also comprise other removable/non-removable, volatile/non-volatile computer storage media. By way of example, FIG. 6 illustrates the mass storage device 604 which can provide non-volatile storage of computer code, computer readable instructions, data structures, program modules, and other data for the computer 601. For example and not meant to be limiting, the mass storage device 604 can be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Optionally, any number of program modules can be stored on the mass storage device 604, including by way of example, the operating system 605 and the access control software 606. Each of the operating system 605 and the access control software 606 (or some combination thereof) can comprise elements of the programming and the access control software 606. The access control data 607 can also be stored on the mass storage device 604. The access control data 607 can be stored in any of one or more databases known in the art. Examples of such databases comprise, DB2®, Microsoft® Access, Microsoft® SQL Server, Oracle®, mySQL, PostgreSQL, and the like. The databases can be centralized or distributed across multiple systems.

In another aspect, the user can enter commands and information into the computer 601 via an input device (not shown). Examples of such input devices comprise, but are not limited to, a keyboard, pointing device (e.g., a "mouse"), a microphone, a joystick, a scanner, tactile input devices such as gloves, and other body coverings, and the like These and other input devices can be connected to the one or more processors 603 via the human machine interface 602 that is coupled to the system bus 613, but can be connected by other interface and bus structures, such as a parallel port, game port, an IEEE 1394 Port (also known as a Firewire port), a serial port, or a universal serial bus (USB).

In yet another aspect, the display device 611 can also be connected to the system bus 613 via an interface, such as the display adapter 609. It is contemplated that the computer 601 can have more than one display adapter 609 and the computer 601 can have more than one display device 611. For example, the display device 611 can be a monitor, an LCD (Liquid Crystal Display), or a projector. In addition to the display device 611, other output peripheral devices can comprise components such as speakers (not shown) and a printer (not shown) which can be connected to the computer 601 via the Input/Output Interface 610. Any step and/or result of the methods can be output in any form to an output device. Such output can be any form of visual representation, including, but not limited to, textual, graphical, animation, audio, tactile, and the like. The display device 611 and computer 601 can be part of one device, or separate devices.

The computer 601 can operate in a networked environment using logical connections to one or more remote computing devices 614*a,b,c*. By way of example, a remote computing device can be a personal computer, portable computer, smartphone, a server, a router, a network computer, a peer device or other common network node, and so on. Logical connections between the computer 601 and a remote computing device 614*a,b,c* can be made via a network 615, such as a local area network (LAN) and/or a general wide area network (WAN). Such network connections can be through the network adapter 608. The network adapter 608 can be implemented in both wired and wireless environments. Such networking environments are conventional and commonplace in dwellings, offices, enterprise-wide computer networks, intranets, and the Internet.

For purposes of illustration, application programs and other executable program components such as the operating system 605 are illustrated herein as discrete blocks, although it is recognized that such programs and components reside at various times in different storage components of the computing device 601, and are executed by the one or more processors 603 of the computer. An implementation of the access control software 606 can be stored on or transmitted across some form of computer readable media. Any of the disclosed methods can be performed by computer readable instructions embodied on computer readable media. Computer readable media can be any available media that can be accessed by a computer. By way of example and not meant to be limiting, computer readable media can comprise "computer storage media" and "communications media." "Computer storage media" comprise volatile and non-volatile, removable and non-removable media implemented in any methods or technology for storage of information such as computer readable instructions, data structures, program modules, or other data. Exemplary computer storage media comprises, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

The systems and methods can employ Artificial Intelligence techniques such as machine learning and iterative learning. Examples of such techniques include, but are not limited to, expert systems, case based reasoning, Bayesian networks, behavior based AI, neural networks, fuzzy systems, evolutionary computation (e.g. genetic algorithms), swarm intelligence (e.g. ant algorithms), and hybrid intelligent systems (e.g. Expert inference rules generated through a neural network or production rules from statistical learning).

While the systems and methods have been described in connection with preferred embodiments and specific examples, it is not intended that the scope be limited to the particular embodiments set forth, as the embodiments herein are intended in all respects to be illustrative rather than restrictive. Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and/or the number or type of embodiments described in the specification.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A system, comprising:

a moveable barrier;

a plurality of loop induction sensors configured to detect a presence of a metallic object; and a programmable logic unit configured to:

receive, from each of the plurality of loop induction sensors, data relating to a change in resonant frequency as the metallic object approaches;

determine, based at least in part on the data relating to the change in resonant frequency received from each of the plurality of loop induction sensors, that each of a plurality of access parameters are satisfied, wherein at least one of the plurality of access parameters specifies one or more frequency signatures indicative of one or more object types; and cause the moveable barrier to move to a position that permits access through an entry point.

2. The system of claim 1, wherein:

the programmable logic unit is configured to determine one or more physical attributes of the metallic object using the data relating to the change in resonant frequency; and the determination that each of the plurality of access parameters are satisfied is based, at least in part, on the one or more physical attributes.

3. The system of claim 2, wherein the one or more physical attributes comprise one or more of a weight, a mass, a length, a height, a width, a shape, or a velocity of the metallic object.

4. The system of claim 1, wherein the programmable logic unit is in communication with the plurality of loop induction sensors by wired or wireless means.

5. The system of claim 1, wherein the programmable logic unit is configured to:

receive a user reconfiguration of one or more settings of at least one loop induction sensor of the plurality of loop induction sensors; and responsive to the user reconfiguration, adjust a sensitivity of the at least one loop induction sensor to metallic mass.

6. The system of claim 1, wherein the moveable barrier is metallic and the programmable logic unit is further configured to:

receive, from each of the plurality of loop induction sensors, further data relating to a second frequency signature of a second metallic object;

determine, based at least in part on the second frequency signature received from each of the plurality of loop induction sensors, that the second metallic object is the moveable barrier; and adjust a sensitivity of at least one of the plurality of loop induction sensors such that the at least one of the plurality of loop induction sensors does not detect the moveable barrier.

7. The system of claim 1, wherein the programmable logic unit is configured to reset one or more sensors of the plurality of loop induction sensors when an anomalous signal is received.

8. The system of claim 7, wherein a signal that is received is determined to be an anomalous signal when the programmable logic unit receives incongruous data from the plurality of loop induction sensors.

9. The method of claim 1, wherein the moveable barrier is an arm-type barrier, a door, a slide gate, a bi-fold gate, a swing gate, a wedge, or a combination thereof.

10. The method of claim 1, wherein the programmable logic unit is in communication with a human-machine interface that facilitates interaction between the programmable logic unit and a user.

11. A method, comprising:

detecting, by a plurality of loop induction sensors, a presence of a metallic object proximate to an entry point barrier, wherein the plurality of loop induction sensors are in communication with a logic unit;

receiving, from one or more of the plurality of loop induction sensors, first data indicating a change in an electrical current caused by a presence of the metallic object proximate to the one or more of the plurality of loop induction sensors;

determining, based on the first data, a plurality of physical attributes of the metallic object and that one or more access parameters are not satisfied, wherein at least one of the one or more access parameters specifies a frequency signature of one or more object types within an electromagnetic field; and causing, based on the one or more access parameters not being satisfied, the entry point barrier to move to a position that blocks the metallic object from passing through the entry point.

12. The method of claim 11, further comprising:

determining, based on the data received from each of the plurality of loop induction sensors, that the metallic object is the entry point barrier;

receiving, from each of the plurality of loop induction sensors, second data indicating a second change in the electrical current; and determining, based on the second data, that a second metallic object is proximate to the entry point barrier.

13. The method of claim 11, wherein the physical attributes comprise one or more of a weight, a mass, a length, a height, a width, or a shape of the metallic object.

14. The method of claim 11, wherein the one or more access parameters comprise one or more of a weight, a mass, a length, a height, a width, a shape, or a velocity of the metallic object.

15. The method of claim 11, wherein the one or more access parameters comprise a number of metallic objects that have passed through the entry point within an interval.

16. The method of claim 11, wherein determining that the one or one access parameters are not satisfied comprises determining, based on the first data, that the metallic object is approaching an exit point adjacent to the entry point.

17. The method of claim 11, further comprising:

receiving, from each of the plurality of loop induction sensors, third data indicating a divergent change in the electrical current;

determining, based on the third data, that at least one of the plurality of loop induction sensors requires a reset or a reconfiguration; and causing the at least one of the plurality of loop induction sensors to be reset or reconfigured such that the at least one of the plurality of loop induction sensors does not send further data indicating a divergent change in the electrical current.

18. The method of claim 17, wherein the logic unit resets or reconfigures the at least one of the plurality of loop induction sensors.

19. The method of claim 18, wherein a user, at an interface in communication with the logic unit, causes the at least one of the plurality of loop induction sensors to be reset or reconfigured.

* * * * *